US005809613A

United States Patent [19]

Baines

[11] Patent Number: 5,809,613

[45] Date of Patent: Sep. 22, 1998

[54] FOOT-OPERATED DOOR STOP ASSEMBLY

[76] Inventor: Richard M. Baines, 51 Sentry Dr., Cartersville, Ga. 30120

[21] Appl. No.: 740,846

[22] Filed: Nov. 4, 1996

Related U.S. Application Data

[60] Provisional application No. 60/007,294, Nov. 9, 1995.

[51] Int. Cl.[6] ..... E05F 5/02

[52] U.S. Cl. ..... 16/82; 292/DIG. 15

[58] Field of Search ..... 16/82, 85, 86 B, 16/86 C; 292/342, 336, 341.17, 341.18, DIG. 15, DIG. 19

[56] References Cited

U.S. PATENT DOCUMENTS

| | | | |
|---|---|---|---|
| 4,142,752 | 3/1979 | Chilton | 16/82 |
| 4,216,986 | 8/1980 | McNinch et al. | 16/82 |
| 4,797,970 | 1/1989 | Charlton | 16/82 |
| 5,056,836 | 10/1991 | Wells | 16/82 |
| 5,447,347 | 9/1995 | Siddons | 292/342 |
| 5,465,460 | 11/1995 | Cantone | 16/82 |

*Primary Examiner*—Chuck Mah

*Attorney, Agent, or Firm*—James W. Kayden; Thomas, Kayden, Horstemeyer & Risley

[57] ABSTRACT

The security device of the present invention is secured to the floor of a structure adjacent the hinged side of a door to be made secure. The security device has a two piece stopping element which lies parallel to the floor and can be elevated by foot from its storage position to engage against the inner face of the door to prevent the door from being opened beyond a minimum amount and then can be depressed by foot to allow for normal usage of the door.

18 Claims, 2 Drawing Sheets

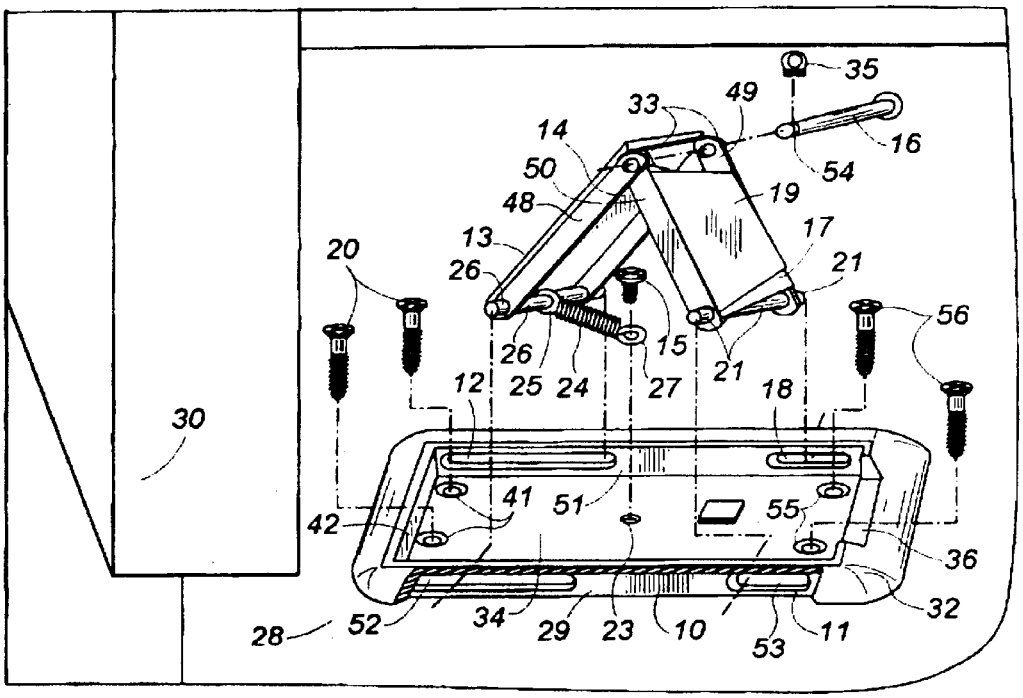
FIG. 1
FIG. 2
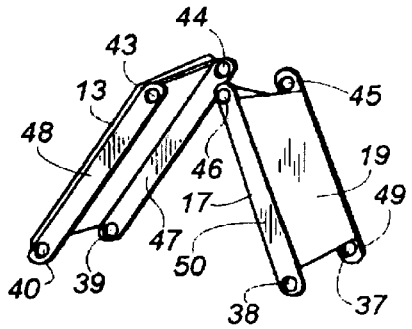
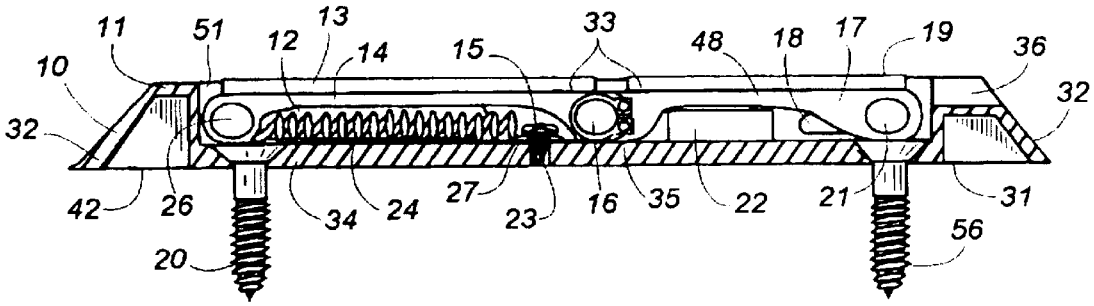
FIG. 3

FOOT-OPERATED DOOR STOP ASSEMBLY

This application claims benefit of USC of Provisional Appln. No. 60/007,294, filed Nov. 9,1995.

BACKGROUND OF THE INVENTION

The present invention was conceived because of a need for a door security device that can be installed without the need to drill a hole or make other modifications to the floor for installation purposes.

This device can be operated by foot and is attractive from the inside and undetectable from the outside. Said device provides as its objectives to be easily installed, sturdy in use and capable of resisting all attempts to reach and disengage said device from intruders.

As of present the main method of securing a door when opened and "ajar" is the use of a chain device. This device is visibly attached to the door and the door facing and the chain can be cut by a pair of bolt cutters or otherwise torn out of the door or door facing by the use of extreme force.

There are some other foot operated door stops, but because of their design, the floor has to be drilled or cut in order for installation. A person would have to have skill or feel comfortable drilling or cutting a hole in order to install these other devices. These other door stops have finger members, latches, vertically disposed springs and stopping members and have other features which means they have to be installed in the floor or removed from the floor when not in use. These devices are more costly to manufacture and harder to assemble and install.

The present invention has for its door stopping element front and back plates pivotally adjoined forming an substantially "A" shape when in a raised position to stop the door and a lower position wherein said stopping element is parallel to the floor and parallel to an extended coil spring raising means allowing normal usage of said door. The device is secured in place with screws and there is no need to drill or cut any additional holes in the floor for installation since the device is of a low profile and the stopping element is stored above and parallel to the housing and interior floors and needs a minimum amount of storage space when down and out of the path of the doorway. The present invention also does not have a latch assembly or other locking means that has to be activated by hand or foot to raise the stopping element to come in contact with the door. A magnet is used to help secure the stopping element in the lowered position and the magnetism of the a magnet is broken by simply stepping on the stopping element which raises the stopping element away from the magnetism of the magnet thus allowing a spring to pull the stopping element to a raised position to come in contact with the door.

The present invention also has for its advantages its simplicity and number of parts required in manufacturing, thus saving cost. With the above results and objectives in view, this new and useful device consists of novel features of construction and arrangement of parts, hereafter fully described.

BRIEF DESCRIPTION OF THE DRAWINGS

FIG. 1 is a perspective view of the present invention in relationship to the door and floor;

FIG. 2 is a perspective view showing in particular the configuration of the stopping element, FIG. 3 is a vertical section of the present invention shown in a lowered position for normal usage of a door;

SUMMARY OF THE INVENTION

Figure 4:
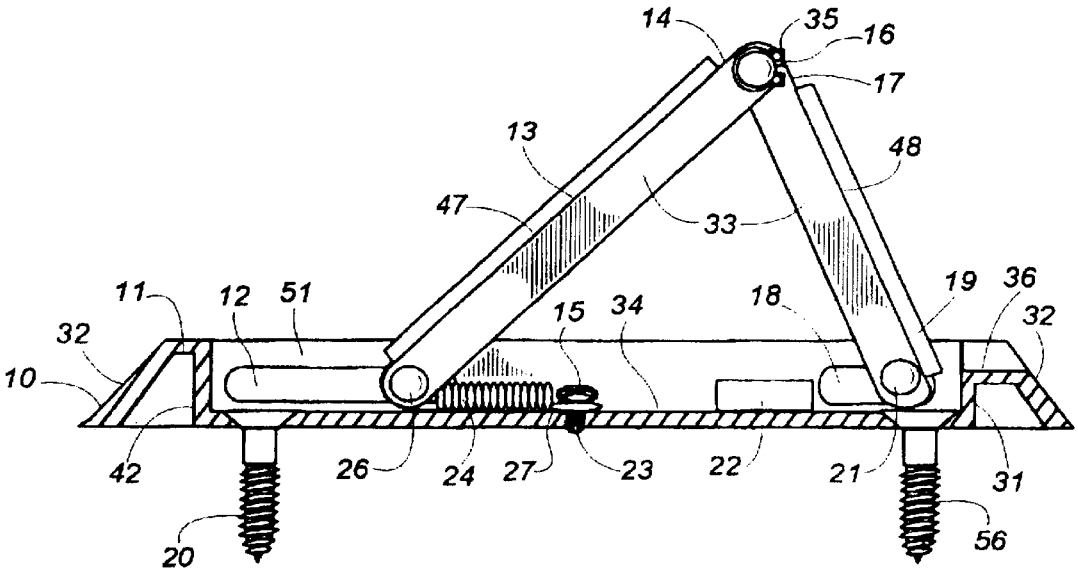
FIG. 4 is a vertical section showing the present invention in a raised position for contact with a door.

The present invention is a simple but most effective means of securing a door after it is "ajar". Said invention allows door to be opened a minimum amount so that the person outside the door may be seen and talked with without permitting his entrance.

The present invention is sturdily made and is rugged in use having a housing which is compact and of a low profile and is fastened to the top surface of the floor.

The present invention has a stopping element mainly comprising two plates which lie in a substantially parallel plane to a spring raising means and to the floor until pressure is exerted to the stopping element allowing the spring raising means to pull the stopping element into a raised position to contact the door. The stopping element is retracted back into its housing and out of the doorway by pressing down on the hinged area of the stopping element by foot.

The present invention also has for its advantages the ability to activate the stopping element without the use of a latch or other means. The stopping element is activated to a raised position by using leverage when exerting force to the back edge of the stopping element. The force raises the stopping element breaking the two plates at the hinged area thus breaking the parallel plane of the stopping element to the housing floor thus giving the spring means the advantage to pull the stopping element to a raised position. A magnet secures the stopping element in the lower position in case the housing is jarred by slamming a door or other activities that might cause the stopping element to be accidentally jarred to a raised position.

Other objectives and advantages will become apparent in the following specifications, when considered in light of the attached drawing.

DETAILED SPECIFICATION

Referring in detail to the drawings wherein similar parts of the present invention or device are identified by like reference numbers.

Device 10 comprising housing 11 which is substantially rectangular in shape having walls which extend up from housing floor 34 to an apex and back down from said apex at an angle to the floor forming a sloped surface 32 around the outer perimeter of said housing 11. The top of housing 11 is open to allow insertion and operation of a pivotally mounted stopping element 33. Housing 11 has symmetrical side walls, left wall 29 containing slots 52 and 53 and right wall 51 containing slots 12 and 18, front wall 42, back wall 31 has a lower surface 36. The floor 34 contains aperture 23, magnet 22, screw holes 41 and 55. Housing 11 is secured to interior floor 28 by screws 20 and 56.

Stopping element 33 comprises front plate 14 located in a front position in housing 11, back plate 17 located in a rear position in housing 11, front plate 14 and back plate 17. adjoined by grooved hinge pin 16. Front plate 14 is substantially rectangular in shape having right leg 47 and left leg 48 which are symmetrical and are formed on the right and left sides of front plate 14. Said legs 47 and 48 strengthen stopping element 33 and contain identical corresponding apertures 39 and 40 which hold pin 26. Pin 26 protrudes outside aperture 39 in right leg 47 and aperture 40 in left leg 48. Said pin 26 is inserted into slots 12 and 52 and secures front plate 14 in housing 11. Sloped surface 32 keeps pin 26 from moving sideways and out of said apertures 39 and 40, and slots 12 and 52. To install front plate 14 in housing 11, pin 26 is inserted through aperture 39, spring loop 25 and aperture 40. Front plate 14 is then turned diagonal to corresponding slots 12 and 52, pin 26 is inserted into slot 12 in the right wall 51 and into slot 52 in left wall 29 as front plate 14 is brought into alignment with housing 11 and parallel to front wall 42 as illustrated in FIG. 5. Self threading screw 15 is inserted through spring loop 27 and screwed into aperture 23 in housing floor 34. Slots 12 and 52 set the movable limits of pin 26 thus setting front to back movable limits of front plate 14 in housing 11. By being elongated, slots 12 and 52 allow front plate 14 to be turned diagonally for installing of pin 26 into said housing 11, to allow stopping element 33 to move forward or backward to a selected raised or lowered position, to allow front plate 14 to move back at pin 26 to install screws 20. Aperture 43 in left leg 48 corresponds to aperture 44 in right leg 47. Said apertures 43 and 44 hold grooved hinge pin 16. Front plate 14 is covered by pad 13 providing a non damaging surface or soft surface for said door 30 to butt against when front plate 14 is in a raised position as illustrated in FIG. 4.

Back plate 17 is substantially rectangular in shape having right leg 49 and left leg 50 which are symmetrical and formed on the right and left sides of back plate 17. Said legs 49 and 50 strengthen stopping element 33 and contain identical corresponding apertures 37 and 38 which hold pin 21. Pin 21 protrudes outside aperture 37 in right leg 49 and aperture 38 in left leg 50, and said pin 21 is inserted into slots 18 and 53 and secures back plate 17 in housing 11. Sloped surface 32 keeps pin 21 from moving sideways and out of said apertures 37 and 38, and slots 18 and 53. To install back plate 17 in housing 11, pin 21 is inserted through aperture 37 and aperture 38. Back plate 17 is then turned diagonal to corresponding slots 18 and 53, pin 21 is inserted into slot 18 in right wall 51 and then into slot 53 in left wall 29 as back plate 17 is brought into alignment with housing 11 and parallel to back wall 31, as illustrated in FIG. 5. Slots 18 and 53 set movable limits of pin 21 thus setting front to back movable limits of back plate 17 in housing 11. Slots 18 and 53 allow back plate 17 to pivot and are elongated to allow said back plate 17 to move forward or backward to allow for a full extension of stopping element 33 in either a raised or lowered position, to allow back plate 17 to move forward at pin 21 for installation of screws 56, and to allow pin 21 to be turned diagonally for installation into housing 11. Aperture 46 in left leg 50 corresponds to aperture 45 in right leg 49. Said apertures 46 and 45 hold grooved hinge pin 16, while grooved hinge pin 16 adjoins back plate 17 and front plate 14 causing stopping element 33 to become aligned in housing 11 and allowing said stopping element 33 to pivot. Back plate 17 is covered by pad 19 providing a non slip surface for activating stopping element 33, by foot, into a raised position to come into contact with door 30.

When stopping element 33 is in a lowered position as illustrated in FIG. 3, coil spring 24 is extended and in tension being connected to pin 26. Pins 26 and 21 and grooved hinge pin 16 are connected to stopping element 33 and act as a pivot means for front plate 14 and back plate 17. Said extended coil spring 24 is unable to pull said pin 26 to its closest position in slots 12 and 52 toward back wall 31 because pins 26 and 21 and grooved hinge pin 16 are concentric and are forced along a substantially common plane parallel to housing floor 34. Said common plane and concentric relationship of pins 26 and 21 and grooved hinge pin 16 are broken by exerting downward force or pressure to the back or front edge of stopping element 33 which breaks front plate 14 and back plate 17 at grooved hinge pin 16. When exerting pressure or force grooved hinge pin 16 rises, pins 26 and 21 and grooved hinge pin 16 become eccentric, allowing coil spring 24, which is in tension, to compress, pulling pin 26 along slots 12 and 52 causing a distance to form between grooved hinge pin 16 and pins 26 and 21. This breaks the substantial parallel plane of stopping element 33 to housing floor 34 and away from the magnetism of magnet 22 and brings pin 26 to its closest position in slots 12 and 52 toward back wall 31 thus raising stopping element 33 to a raised position to come in contact with door 30 as illustrated in FIG. 4.

Figure 5:
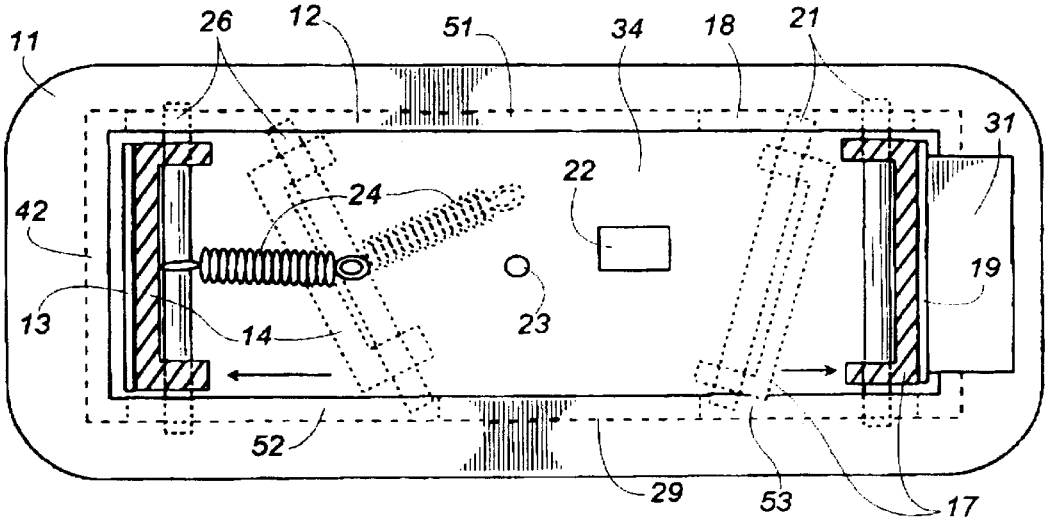
FIG. 5 is a top view showing the manner in which the two (2) piece stopping element is installed into the housing.

When stopping element 33 is in a raised position front plate 14 and back plate 17 form a substantial "A" shape as illustrated in FIG. 4. When door 30 contacts pad 13 it pushes on front plate 14 which is supported at the bottom by pin 26 in slots 12 and 52. Said pin 26 is now at its closest point toward back wall 31 and is supported at the vertex by foot plate 17 which is adjoined to front plate 14 by grooved hinge pin 16. Back plate 17 supports and strengthens front plate 14 by its angular connection to said front plate 14, said back plate 17 is supported at the bottom by pin 21 in slots 18 and 53.

When stopping element 33 is in a raised position as illustrated in FIG. 4, it can be stored to a lowered position as illustrated in FIG. 3 by exerting downward force or pressure to the vertex of stopping element 33 at grooved hinge pin 16 or by pushing forward on pad 19 causing said back plate 17 and the front plate 14 to move in a outward direction and away from its closest proximity to each other at pin 21 and 26. This action forces stopping element 33 down into a substantial parallel plane to housing floor 34 and out of the path of door 30 as illustrated in FIG. 3. When stopping element 33 is in a lowered position, the coil spring 24 connected to pin 21 exerts force to pins 21 and 26 and grooved hinge pin 16 which are concentric. Said pins 21 and 26 and grooved hinge pin 16 will not become eccentric until force is applied to said stopping element 33, as previously stated. Magnet 22 is used to secure said stopping element 33 in the lowered position in the event said device 10 is jarred, which might activate said stopping element 33 to a raised position prematurely.

While the present invention has been described herein with reference to particular embodiments thereof, a latitude of modification, various changes and substitutions are intended in the disclosure, and in some instances some features of the invention will be employed without a corresponding use of other features without departing the scope of the invention as set forth.

What is claimed is:

1. A door stop assembly for installation to the floor and secured to the floor on the side to which the door opens, comprising a housing having side walls with slots formed in said side walls, a stopping element with front and back plates and a hinge means therebetween for pivotally connecting said plates, said stopping element including connecting means extending therefrom and disposed in sail slots for connecting said element to said housing, said stopping element having a first position below the path of the door and a second raised position with said plates disposed in the path of the door to prevent the opening thereof, and biasing means operatively connected to said stopping element for selectively urging said stopping element to said raised position upon activation by a user.

2. A foot operated door stop assembly as defined in claim 1 in which said front plate is urged to said raised position by said biasing means upon application of force to said stopping element.

3. A door stop assembly as defined in claim 1 in which said front plate is urged to said raised position by said biasing means upon application of force to said back plate.

4. A door stop assembly as defined in claim 1 and including a stopping element securing means for holding said element in said first position.

5. A door stop assembly as defined in claim 4 in which said securing means comprises a magnet disposed in said housing below said stopping element for maintaining said stopping element in a position parallel to the floor.

6. A door stop assembly as defined in claim 1, in which said spring means is connected to said front plate for moving said front plate toward said back plate to angularly dispose said plates in the path of the door.

7. A door stop assembly as defined in claim 1 in which the alignment of said hinge means and connecting means holds said stopping element in inertia and a first position until force is applied to said stopping element thus making changes to said alignment and allowing biasing means to urge said stopping element to a raised position.

8. A door stop assembly as defined in claim 1 in which said stopping element remains parallel in said housing when in tension because said hinge and said connecting means are in a substantially common plane and substantial concentric relationship.

9. A foot operated door stop assembly for installation on a floor and secured to the floor on the side to which the door opens, comprising a housing having side walls having elongated slots formed therein, a stopping element comprising hinged front and back plates disposed in said housing and being horizontally positioned with respect to the floor when in a lower position below the path of the door, and an angular position relative to said floor when in an upper position, said stopping element being adjoined to said housing and having pins extending outwardly therefrom disposed in said elongated slots for defining the limits of movement of said plates, and a raising means for raising said stopping element to said angular position and into the path of the door as pressure is applied to said stopping element.

10. A foot operated door stop assembly as defined in claim 9 in which said stop assembly includes a means for holding said stopping element in a horizontal position.

11. A foot operated door stop assembly as defined in claim 9 wherein said means for holding comprises a magnet.

12. A door stop assembly mounted to a floor on the side to which a door is opened and disposed in the path thereof, said assembly comprising a generally rectangular housing having a central portion with side walls disposed therealong, said side walls having elongated slots formed therein, a door stopping element comprising front and back plates with a hinge disposed therebetween for pivotally connecting said front and back plates, said front and back plates having pins extending outwardly therefrom for engaging said slots for maintaining said plates within said housing, holding means disposed in said housing being operatively associated with said stopping element for maintaining said front plate in a position substantially parallel to said back plate, spring means connected to said front plate and operable to pull said front plate toward said back plate by way of said slots and disposing said front and back plates in an angular position relative to the floor upon disengagement of said holding means by the user to position said front and back plates in the path of the door to prevent the opening thereof.

13. A door stop assembly according to claim 12, in which said holding means comprises a magnet.

14. A door stop assembly as defined in claim 12 in which said slots define the limits of movement of said front and back plates between their horizontal and angular positions.

15. A door stop assembly as defined in claim 12 in which the alignment of said hinge and pins holds said stopping element in inertia and a first position until force is applied to said stopping element thus making changes to said alignment and allowing biasing means to urge said stopping element to a raised position.

16. A door stop assembly as defined in claim 12 in which said plates are in tension when they are parallel within said housing and will not break at said hinge and come to said angular position as said hinge and said pins are in force along a common axis.

17. A door stop assembly as defined in claim 12 in which said stopping element remains parallel in said housing when in tension because said hinge and pins are being pulled along a substantially common axis.

18. A door stop assembly as defined in claim 12 in which said stopping element remains parallel in said housing when in tension because said hinge and said pins are in a substantially common plane and substantial concentric relationship.

* * * * *